US006413152B1

(12) United States Patent
Sengupta et al.

(10) Patent No.: US 6,413,152 B1
(45) Date of Patent: Jul. 2, 2002

(54) APPARATUS FOR PERFORMING CHEMICAL-MECHANICAL PLANARIZATION WITH IMPROVED PROCESS WINDOW, PROCESS FLEXIBILITY AND COST

(75) Inventors: Samit Sengupta, San Jose, CA (US); Charles F. Drill, Rio Rancho, NM (US)

(73) Assignee: Philips Electronics North American Corporation, New York, NY (US)

( * ) Notice: Subject to any disclaimer, the term of this patent is extended or adjusted under 35 U.S.C. 154(b) by 0 days.

(21) Appl. No.: 09/470,296

(22) Filed: Dec. 22, 1999

(51) Int. Cl.[7] ..... B24B 7/00

(52) U.S. Cl. ..... 451/66; 451/65; 451/57; 451/41; 451/287

(58) Field of Search ..... 451/65, 66, 57, 451/41, 291–285; 438/692–693; 156/345

(56) References Cited

U.S. PATENT DOCUMENTS

| | | | | |
|---|---|---|---|---|
| 5,549,502 A | | 8/1996 | Tanaka et al. | 451/8 |
| 5,649,854 A | | 7/1997 | Gill, Jr. | 451/290 |
| 5,679,059 A | | 10/1997 | Nishi et al. | 451/41 |
| 5,899,792 A | * | 5/1999 | Yagi | 451/6 |
| 5,924,916 A | * | 7/1999 | Yamashita | 451/288 |
| 5,938,884 A | | 8/1999 | Hoshizaki et al. | 156/345 |
| 5,975,994 A | * | 11/1999 | Sandhu et al. | 451/56 |
| 5,997,384 A | * | 12/1999 | Blalock | 451/41 |
| 6,015,499 A | * | 1/2000 | Hayden | 210/767 |
| 6,068,542 A | * | 5/2000 | Hosokai | 451/37 |
| 6,136,138 A | * | 10/2000 | Yagisawa | 156/345 |
| 6,193,588 B1 | * | 2/2001 | Carlson et al. | 451/66 |
| 6,227,956 B1 | * | 5/2001 | Halley | 451/288 |

FOREIGN PATENT DOCUMENTS

| | | | |
|---|---|---|---|
| DE | 29709755 | 9/1997 | B24B/29/02 |

* cited by examiner

*Primary Examiner*—George Nguyen
(74) *Attorney, Agent, or Firm*—Wagner, Murabito & Hao LLP

(57) ABSTRACT

An apparatus for chemical-mechanical planarization (CMP) of semiconductor wafers that allows independent micro-control of each spindle for tailored CMP performance. The present invention provides, in one embodiment, a CMP tool that includes a stationary bridge that houses a rack and pinion assembly. The rack and pinion assembly is coupled to a plurality of motor assemblies each of which is coupled to rotate a spindle. Significantly, movements of the spindles across are individually and independently controlled by the rack and pinion assembly. An advantage of the present independent spindle motion design allows optimization of the CMP process for each spindle and enables more accurate prediction of the effect of translation on CMP performance. Independent rotation and downforce capability of the present invention provides additional flexibility in terms of tuning polish rates and uniformity. Another advantage of the present invention is that a more compact enclosure for wafer isolation can be achieved.

19 Claims, 2 Drawing Sheets

APPARATUS FOR PERFORMING CHEMICAL-MECHANICAL PLANARIZATION WITH IMPROVED PROCESS WINDOW, PROCESS FLEXIBILITY AND COST

FIELD OF THE INVENTION

The field of the present invention pertains equipment and machines for semiconductor fabrication processing. More particularly, the present invention relates to equipment and machines for CMP (chemical mechanical planarization) of semiconductor wafers.

BACKGROUND OF THE INVENTION

Most of the power and usefulness of today's digital IC devices can be attributed to the increasing levels of integration. More and more components (resistors, diodes, transistors, and the like) are continually being integrated into the underlying chip, or IC. The starting material for typical ICs is very high purity silicon. The material is grown as a single crystal. It takes the shape of a solid cylinder. This crystal is then sawed (like a loaf of bread) to produce wafers typically 10 to 30 cm in diameter and 250 microns thick.

The geometry of the features of the IC components are commonly defined photographically through a process known as photolithography. Very fine surface geometries can be reproduced accurately by this technique. The photolithography process is used to define component regions and build up components one layer on top of another. Complex ICs can often have many different built-up layers, each layer having components, each layer having differing interconnections, and each layer stacked on top of the previous layer. The resulting topography of these complex IC's often resemble familiar terrestrial "mountain ranges," with many "hills" and "valleys" as the IC components are built up on the underlying surface of the silicon wafer.

In the photolithography process, a mask image, or pattern, defining the various components is focused onto a photosensitive layer using ultraviolet light. The image is focused onto the surface using the optical means of the photolithography tool and is imprinted into the photosensitive layer. To build ever smaller features, increasingly fine images must be focused onto the surface of the photosensitive layer, e.g. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable and, thus, the smallest components obtainable using the photolithography tool. The extreme topography of complex ICs, the "hills" and "valleys," exaggerate the effects of decreasing depth of focus. Thus, in order properly to focus the mask image defining sub-micron geometries onto the photosensitive layer, a precisely flat surface is desired. The precisely flat (e.g. fully planarized) surface will allow for extremely small depths of focus and, in turn, allow the definition and subsequent fabrication of extremely small components.

Chemical-mechanical planarization (CMP) is the preferred method of obtaining full planarization of a wafer. It involves removing a sacrificial layer of dielectric material or metal using mechanical contact between the wafer and a moving polishing pad with chemical assistance from a polishing slurry. Polishing flattens out height differences since high areas of topography (hills) are removed faster than areas of low topography (valleys). CMP is the only technique with the capability of smoothing out topography over millimeter scale planarization distances leading to maximum angles of much less than one degree after polishing.

FIG. 1 shows a side cut away view of a conventional CMP machine 100 such as the Strasbaugh 6DS-SP. CMP machine 100 typically consists of a platen 104, or turn table, covered with a polishing pad 102 that is made of resilient material. The polishing pad 102 is typically textured, often with a plurality of predetermined grooves, to aid the polishing process. The polishing pad 102 and the platen 104 rotate at a predetermined speed. Wafers 105 are held in place at the bottom ends of spindles 101 to be polished face-down. Spindles 101 are rotated by motor assembly 110 that are located within a bridge housing 120. The bridge housing 120 itself moves in a translatory motion (illustrated by arrow 130) allowing the wafers 105 to cover more of surface of the polishing pad 102. Typically, CMP machine 100 also includes a slurry dispense mechanisms for dispensing a flow of slurry onto the polishing pad 102. CMP machine 100 may also include an enclosure 140 for providing an isolated environment for CMP operations.

The slurry is a mixture of de-ionized water and polishing agents designed to chemically and mechanically smoothen and predictably planarize the wafer. The rotating action of both the polishing pad 102 and the spindles 101 and the translatory motion of the bridge housing 120, in conjunction with the polishing action of the slurry, combine to planarize, or polish, the wafers 105 such that topography over millimeter scale planarization distances is nearly completely smoothed away. Once CMP is complete, wafers 105 are removed from polishing pad 102 and are prepared for the next phase in the device fabrication process.

The rate at which the wafers 105 are planarized is generally referred to as the removal rate. A constant and predictable removal rate is important to the uniformity and performance of the wafer fabrication process. The removal rate should be expedient, yet yield precisely planarized wafers, free from surface topography. If the removal rate is too slow, the number of planarized wafers produced in a given period of time decreases, degrading wafer through-put of the fabrication process. If the removal rate is too fast, the CMP planarization process may not be uniform across the surface of the wafers, degrading the yield of the fabrication process. Thus, it is important to precisely control the removal rate.

The removal rate, however, may vary from one wafer to another. Even when the wafers are polished at the same time, unevenness on the surfaces of the wafers and the polishing pad may cause one wafer to be polished faster than another. The removal rate may also vary from one batch of wafers to another batch if the polishing pad wears down unevenly. The result is that the wafers may not be uniformly planarized.

Therefore, what is needed is an improved apparatus and methodology for performing CMP. What is further needed is an apparatus for performing CMP such that the wafers are uniformly planarized.

SUMMARY OF THE DISCLOSURE

Accordingly, the present invention provides an apparatus for performing chemical-mechanical planarization (CMP) of semiconductor wafers with improved process window, process flexibility and cost. Particularly, the present invention allows independent micro-control of each spindle for tailored CMP performance.

The present invention provides, in one embodiment, a CMP apparatus that includes a stationary bridge that houses a rack and pinion assembly. The rack and pinion assembly is coupled to a plurality of spindle motor assemblies each of which is coupled to rotate a spindle. Significantly, translation of the spindles is achieved with the rack and pinion assembly. Further, the translation of the spindles can be independently and individually controlled. An advantage of the present independent spindle motion design allows optimization of the CMP process for each spindle and enables more accurate prediction of the effect of translation on CMP performance. Independent rotation and downforce capability of the present invention provides additional flexibility in terms of tuning polish rates and uniformity. Another advantage of the present invention is that a more compact enclosure for wafer isolation can be achieved.

According to one embodiment of the invention, the CMP apparatus includes a turn-table covered by a polishing pad; spindles operable to push wafers against the polishing pad; spindle motor assemblies coupled to the spindles and operable to rotate the wafers on the polishing pad. Translational motions of the spindles across the polishing pad are individually driven by rack and pinion mechanisms contained within a bridge housing. In the present embodiment, the rack and pinion assemblies are individually micro-controlled to achieve CMP performance that is custom tailored for the particular CMP process.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, an apparatus for performing CMP with improved process window, process flexibility and cost, an example of which is illustrated in the accompanying drawing. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits are not described in detail so as to avoid obscuring aspects of the present invention.

Chemical-mechanical planarization (CMP) is the preferred method of obtaining full planarization of a semiconductor wafer containing devices for fabrication processing. The CMP process involves removing one or more layers of material (e.g., dielectric material, aluminum, tungsten, or copper layers, or the like) using both the frictional contact between the wafer and a moving polishing pad saturated with a polishing slurry and the chemical action of the slurry itself. Polishing through the CMP process flattens out height differences, since high areas of topography (hills) are removed faster than areas of low topography (valleys). The CMP process is the preferred technique with the capability of smoothing out topography over millimeter scale planarization distances leading to maximum angles of much less than one degree after polishing.

The present invention provides an apparatus for chemical-mechanical planarization (CMP) of semiconductor wafers that allows independent micro-control of each spindle for tailored CMP performance. The CMP apparatus of the present embodiment includes a stationary bridge that houses a rack and pinion assembly. The rack and pinion assembly is coupled to a plurality of motor assemblies each of which is coupled to rotate a spindle. Significantly, translational movement of the spindles are individually and independently controlled by the rack and pinion assembly. An advantage of the present independent spindle motion design allows optimization of the CMP process for each spindle and enables more accurate prediction of the effect of translation on CMP performance. Independent rotation and downforce capability of the present invention provides additional flexibility in terms of tuning polish rates and uniformity. Another advantage of the present invention is that a more compact enclosure for wafer isolation can be achieved.

Figure 1:
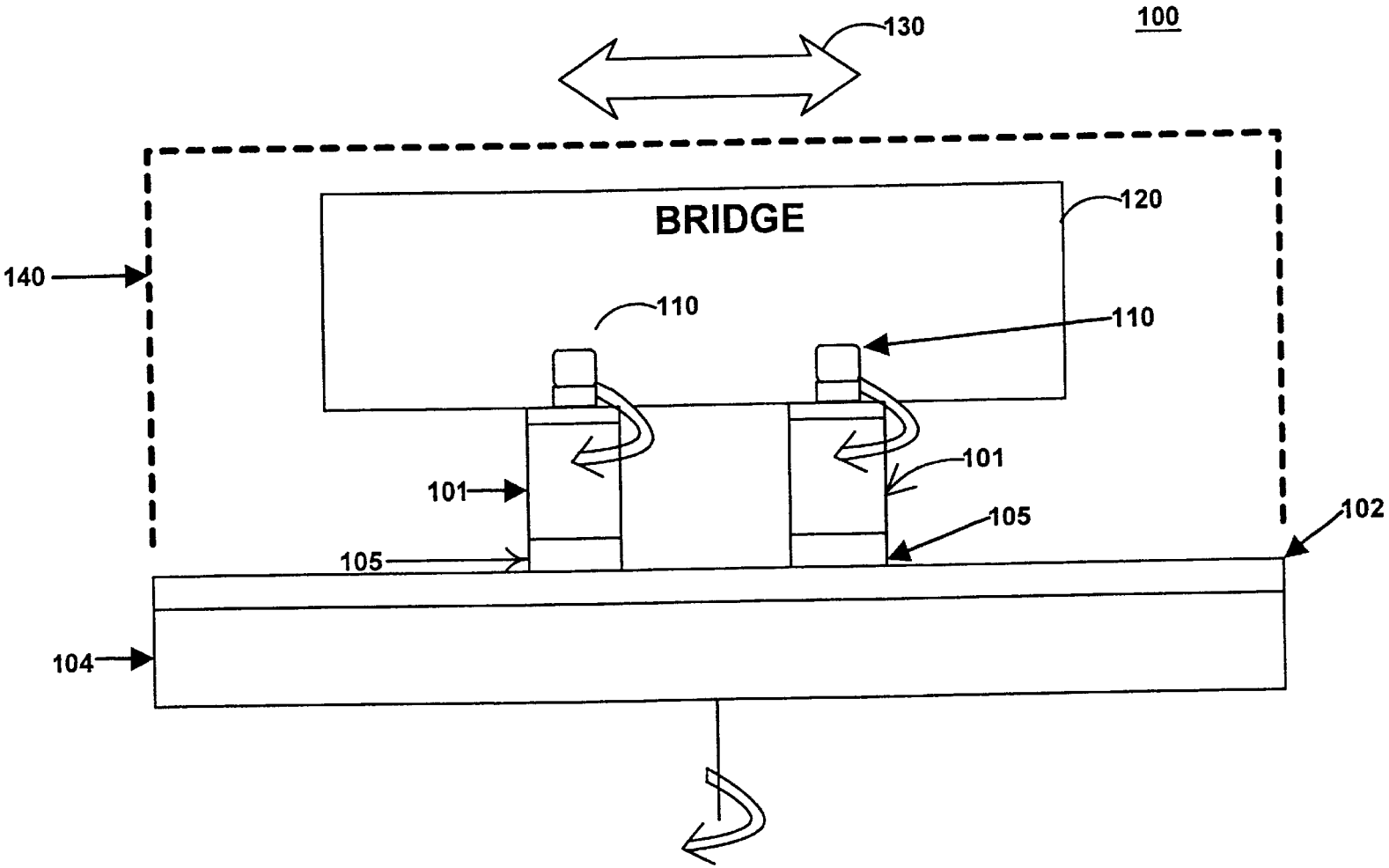
FIG. 1 (Prior Art)
FIG. 1 shows a side view of a conventional CMP machine.
Figure 2:
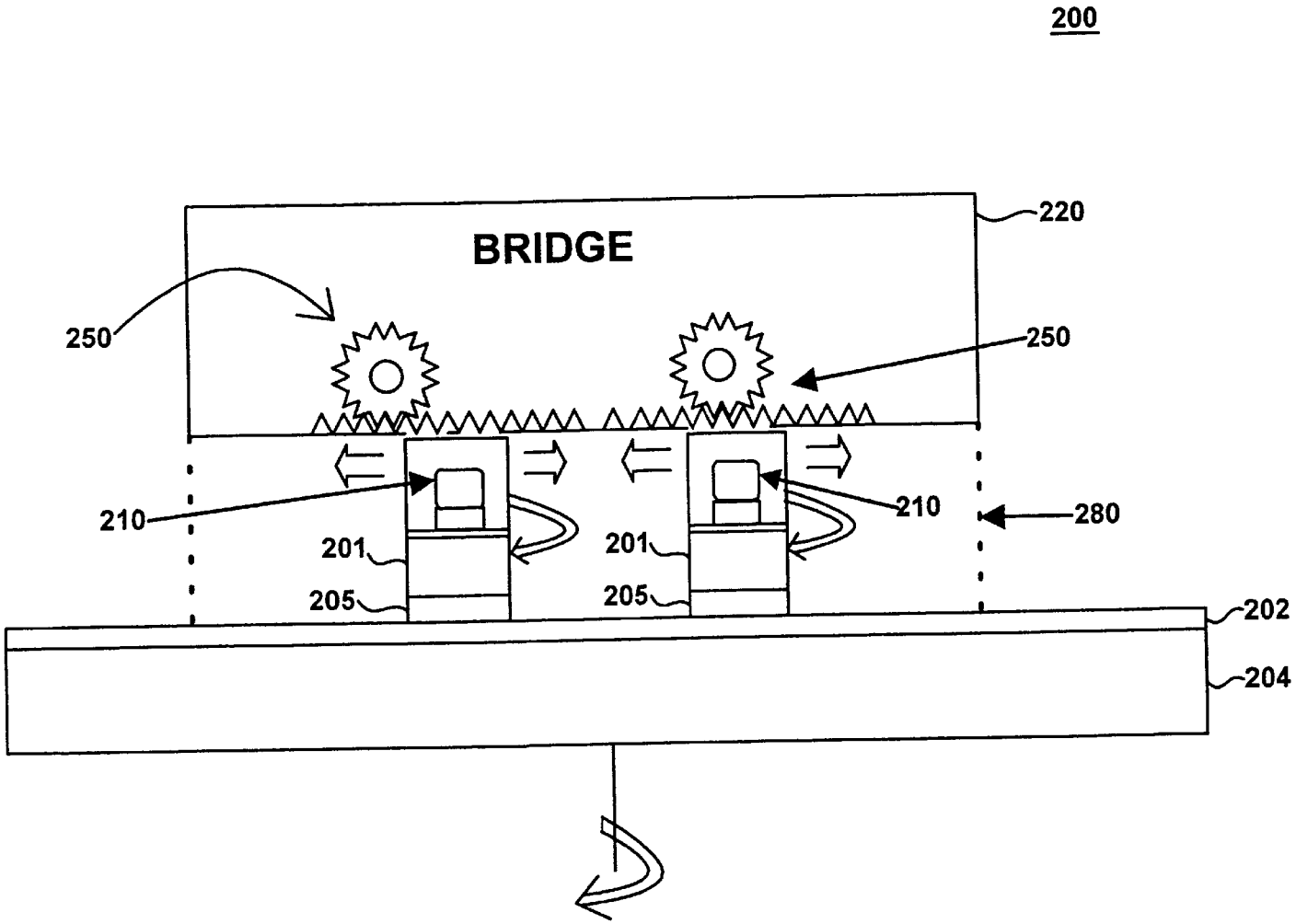
FIG. 2 shows an expository side view of a CMP machine in accordance with an embodiment of the present invention.

FIG. 2 shows a side cut away view of a CMP machine 200 in accordance with an embodiment of the present invention. CMP machine 200 consists of a platen 204, or turn table, covered with a polishing pad 202. The polishing pad 202 and the platen 204 rotate at a predetermined speed. Wafers 205 are held in place at the bottom ends of spindles 201 to be polished face-down. Spindles 201 are rotated by spindle motor assemblies 210 that are coupled between a bridge housing 220 and the spindles 201. The bridge housing 220 itself is stationary. CMP machine 200 may also include a slurry dispense mechanisms for dispensing a flow of slurry onto the polishing pad 202. CMP machine 200 may also be coupled to machines and apparatus that monitor the polish rate of the wafers 205.

Significantly, as illustrated in FIG. 2, bridge housing 220 contains rack and pinion assemblies 250. As shown, each rack and pinion assembly 250 is coupled to spindle motor assembly 210. In the present embodiment, each rack and pinion assembly 250 is coupled to an electronic control system (not shown) of the CMP machine 200.

In operation, the rack and pinion assembly 250 is individually controlled to provide independently adjustable translational movement to the spindles 201. In other words, translational movement of one spindle is completely independent of the movement of another spindle. In comparison to conventional CMP machines (e.g., CMP machine 100), the present invention provides an additional degree of freedom to the movement of the spindles 201, thus enabling the CMP process to be optimized for each individual spindle 201. For example, if one of the wafers 205 is polished at a higher rate than another, translational movement of the corresponding spindle(s) can be adjusted to increase/decrease the polish rate.

In furtherance of the present embodiment, rotational motion of the spindles 201 are individually controlled by spindle motor assemblies 210. Additionally, bridge housing 220 contains mechanisms (not shown) for providing each spindle 201 independently and individually adjustable downforce. Independent rotation and downforce capability of the present invention provides additional flexibility in terms of tuning polish rates and uniformity.

Another advantage of the present invention is that a more compact enclosure for wafer isolation can be achieved. CMP processes may introduce defects in the semiconductor wafers. One possible defect formed by CMP processes is the formation of oxidation layer on a component in semiconductor wafers. The oxidation layer may affect subsequent fabrication operations on semiconductor wafers such as adhesion of subsequently deposited layers of material. The presence of dirt or other physical contaminants may affect the flatness or smoothness of the finished semiconductor wafer. The particles may be of a size, hardness or characteristic that affects the CMP operation. Hence, it is important to eliminate oxygen, foreign particles and moisture contaminants in the CMP operation. A more detailed description of the contamination problems during the CMP operations and their solutions can be found in U.S. patent application Ser. No. 09/305,977, filed May 5, 1999, and entitled "Method and Apparatus For A Gaseous Environment Providing Improved Control of CMP Process", by Charles F. Drill et al., and assigned to the present assignee, which is incorporated herein by reference as background material.

Accordingly, in the present embodiment, the CMP apparatus 200 includes an optional sealed enclosure 280 for providing an isolated environment for CMP operations. In other solutions to the CMP contamination problems, the entire CMP machine (e.g., CMP machine 100) has to be enclosed to provide an isolated environment for the wafers. In comparison, in present embodiment, a more compact enclosure 280 can be achieved because the bridge housing 200 is stationary.

It should be appreciated, however, that the present invention does not require a stationary bridge housing. In an another embodiment of the present invention, the bridge housing may be movable to provide translational movement to complement the translational movement provided by the rack and pinion assembly. In that embodiment, the translational movement provided by the bridge housing may be perpendicular to that provided by the rack and pinion assembly. In this way, even more process flexibility can be achieved.

The present invention, an apparatus for chemical-mechanical planarization with improved process window, process flexibility and cost, has thus been disclosed. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the claims appended hereto and their equivalents.

What is claimed is:

1. An apparatus for chemical and mechanical planarization (CMP) of wafers comprising:

a platen covered by a polishing pad;

a first spindle operable to push a first wafer against said polishing pad;

a second spindle operable to push a second wafer against said polishing pad; and a bridge housing coupled to said first spindle and said second spindle, wherein said bridge housing is operable to cause said first wafer to move in a first translational motion on said polishing pad and operable to cause said second wafer to move in a second translational motion on said polishing pad, and wherein said first translational motion is independent with respect to said second translational motion.

2. An apparatus as recited in claim 1 wherein said platen is operable to rotate at a predetermined speed.

3. An apparatus as recited in claim 1 further comprising:

a first spindle motor assembly operable to rotate said first wafer on said polishing pad; and a second spindle motor assembly operable to rotate said second wafer on said polishing pad.

4. An apparatus as recited in claim 3 wherein rotational speeds of said first wafer and said second wafer are independently adjustable.

5. An apparatus as recited in claim 1 wherein said bridge housing comprises a first rack and pinion mechanism coupled to said first spindle for providing said first translational motion.

6. An apparatus as recited in claim 5 wherein said bridge housing comprises a second rack and pinion mechanism coupled to said second spindle for providing said second translational motion.

7. An apparatus as recited in claim 1 wherein said bridge housing is stationary with respect to said platen during CMP operations.

8. An apparatus as recited in claim 1 further comprising a sealed enclosure for isolating said first wafer and said second wafer during CMP operations.

9. An apparatus for chemical-mechanical planarization (CMP) of semiconductor wafers comprising:

a platen covered by a polishing pad wherein said platen is operable to rotate at a predetermined speed;

a first spindle operable to push a first wafer against said polishing pad;

a first spindle motor assembly coupled to said first spindle and operable to rotate said first wafer on said polishing pad;

a second spindle operable to push a second wafer against said polishing pad;

a second spindle motor assembly coupled to said second spindle and operable to rotate said second wafer on said polishing pad; and a bridge housing coupled to said first spindle and second spindle, wherein said bridge housing is operable to cause said first wafer to move in a first translational motion on said polishing pad and operable to cause said second wafer to move in a second translational motion on said polishing pad, and wherein said first translational motion is independent with respect to said second translational motion.

10. An apparatus as recited in claim 9 wherein said bridge housing comprises a first rack and pinion mechanism coupled to said first spindle for providing said first translational motion.

11. An apparatus as recited in claim 10 wherein said bridge housing comprises a second rack and pinion mechanism coupled to said second spindle for providing said second translational motion.

12. An apparatus as recited in claim 9 wherein said bridge housing, is stationary with respect to said platen during CMP operations.

13. An apparatus as recited in claim 9 further comprising a sealed enclosure for isolating said first wafer and said second wafer during CMP operations.

14. An apparatus for chemical-mechanical planarization (CMP) of semiconductor wafers comprising:

a platen covered by a polishing pad wherein said platen is operable to rotate at a predetermined speed;

a first spindle operable to push a first wafer against said polishing pad;

a first spindle motor assembly coupled to said first spindle and operable to rotate said first wafer on said polishing pad;

a first rack and pinion mechanism coupled to said first spindle motor assembly and operable to cause said first wafer to move in a first translational motion on said polishing pad;

a second spindle operable to push a second wafer against said polishing pad;

a second spindle motor assembly coupled to said second spindle and operable to rotate said second wafer on said polishing pad;

a second rack and pinion mechanism coupled to said second spindle and operable to cause said second wafer to move in a second translational motion on said polishing pad;

a bridge housing containing said first rack and pinion mechanism and said second rack and pinion mechanism and wherein said first translational motion is independent with respect to said second translational motion.

15. A method of polishing semiconductor wafers comprising the steps of:

placing a first wafer between a first spindle and surface of said a polishing pad of a chemical-mechanical planarization (CMP) apparatus;

placing a second wafer between a second spindle and said surface of said polishing pad;

causing said first wafer to move on said surface of said polishing pad in a first translational motion; and causing said second wafer to move across said surface of said polishing pad in a second translational motion wherein said first translational motion is independent with respect to said second translational motion.

16. A method as recited in claim 15 further comprising the steps of:

rotating said first wafer on said surface of said polishing pad by rotating said first spindle; and rotating said second wafer on said surface of said polishing pad by rotating said second spindle.

17. A method as recited in claim 15 further comprising the step of rotating said polishing pad.

18. A method as recited in claim 15 wherein said first translational motion and said second translational motion are produced by rack and pinion mechanisms contained within a bridge housing of said CMP apparatus.

19. A method as recited in claim 15 further comprising the step of providing a sealed enclosure for isolating said first wafer and said second wafer during CMP operations.

* * * * *